US005516984A

United States Patent [19]

Soes et al.

[11] Patent Number: 5,516,984

[45] Date of Patent: May 14, 1996

[54] ELECTRICAL CONNECTOR HAVING IMPROVED STRAIN RELIEF

[75] Inventors: Lucas Soes, Rosmalen; Hermann P. J. Gilissen, Esch, both of Netherlands

[73] Assignee: The Whitaker Corporation, Wilmington, Del.

[21] Appl. No.: 442,598

[22] Filed: May 17, 1995

Related U.S. Application Data

[63] Continuation of Ser. No. 121,839, Sep. 15, 1993, abandoned.

[30] Foreign Application Priority Data

Oct. 7, 1992 [GB] United Kingdom ..... 9221103

[51] Int. Cl.[6] ..... H01R 13/428; H01R 13/58

[52] U.S. Cl. ..... 174/65 R; 439/467

[58] Field of Search ..... 174/65 R; 439/449, 439/465, 467

[56] References Cited

U.S. PATENT DOCUMENTS

| | | | |
|---|---|---|---|
| 3,576,518 | 4/1971 | Bazille, Jr. et al. | 439/402 |
| 4,413,872 | 11/1983 | Rudy, Jr. et al. | 439/467 |
| 4,537,456 | 8/1985 | Brown et al. | 439/404 |
| 5,037,325 | 8/1991 | Wirkus | 439/467 |
| 5,080,606 | 1/1992 | Burkard | 439/403 |
| 5,190,470 | 3/1993 | Soes et al. | 439/417 |

FOREIGN PATENT DOCUMENTS

| | | |
|---|---|---|
| 0077610 | 9/1982 | European Pat. Off. . |
| 0489549 | 6/1992 | European Pat. Off. . |
| 8602543 | 4/1986 | Germany . |
| 2002599A | 8/1978 | United Kingdom . |
| 9202974 | 2/1992 | WIPO . |

*Primary Examiner*—Kristine L. Kincaid
*Assistant Examiner*—Paramita Ghosh
*Attorney, Agent, or Firm*—Eric J. Groen; Driscoll A. Nina

[57] ABSTRACT

An insulating housing for mounting in a mating female connector housing of an electrical connector, whereby the insulating housing is a two-piece construction including a housing member which receives a cover therein. The cover comprises a strain relief member which, in a preferred embodiment, is integrally formed as part of the cover and which comprises a plurality of teeth. When the cover is mounted in the insulating housing, the strain relief member may be pivoted from an unlocked to a locked position, whereupon the plurality of teeth bite into the insulation of the insulated wires, thereby relieving strain on the insulated wires.

20 Claims, 4 Drawing Sheets

ELECTRICAL CONNECTOR HAVING IMPROVED STRAIN RELIEF

This application is a Continuation of application Ser. No. 08/121,839 filed Sep. 15, 1993, now abandoned.

BACKGROUND OF THE INVENTION

1. Field of the Invention

This invention relates to an electrical connector, and more particularly, it relates to an electrical connector comprising an insulating housing having a housing member for receiving a cover having strain relief means for relieving strain on the plurality of insulated conductors which are inserted into the insulating housing.

2. Description of the Prior Art

European Patent Application No. 91 311 083.9, which is assigned to the same assignee as the present application, discloses an electrical wire connector 2 comprising a one-piece molded female insulating housing 4, having wire receiving electrical terminal 6 secured therein, and a one-piece molded male insulating housing 8 for mating with the housing 4. The male housing 8 has a row of wire receiving passageways 48 each intersecting a slot 56 in the male housing 8. The slot 56 receives the wire receiving part 30 of a respective terminal 6 when the male housing 8 has been fully inserted into the female housing 4. Wires (W) previously inserted into the wire receiving passages 48 are forced into the wire receiving slots 44 of the terminals 6 during the insertion of the male housing 8 into the female housing 4.

Although the device shown and described in this European patent application has many unique features, it may be desired to provide an electrical connector having improved strain relief.

SUMMARY OF THE INVENTION

An object of this invention is to provide an electrical connector having improved strain relief for relieving strain on a plurality of insulated conductors which are terminated in the electrical connector.

Another object of this invention is to provide an insulating housing for mounting in a female connector housing, whereby the insulating housing comprises a cover member which is mounted on a housing member and which comprises strain relief means integrally formed as part of the cover.

Still another object of this invention is to provide an electrical connector comprising an insulating housing having a cover with an integrally formed strain relief comprising a plurality of teeth for engaging the insulation on a plurality of insulated conductors which are inserted into the insulating housing.

In one aspect of the invention, this invention comprises an insulating housing for coupling to a female connector housing having a plurality of electrical terminals, said insulating housing comprising a housing member; a cover for mounting on said housing member, said housing member and said cover each having a plurality of slots for receiving said plurality of electrical terminals; and strain relief means associated with said cover for securing a plurality of insulated conductors in operative relationship with said plurality of slots and also for relieving strain on said plurality of insulated conductors.

DETAILED DESCRIPTION OF THE PREFERRED EMBODIMENT

Figure 1:
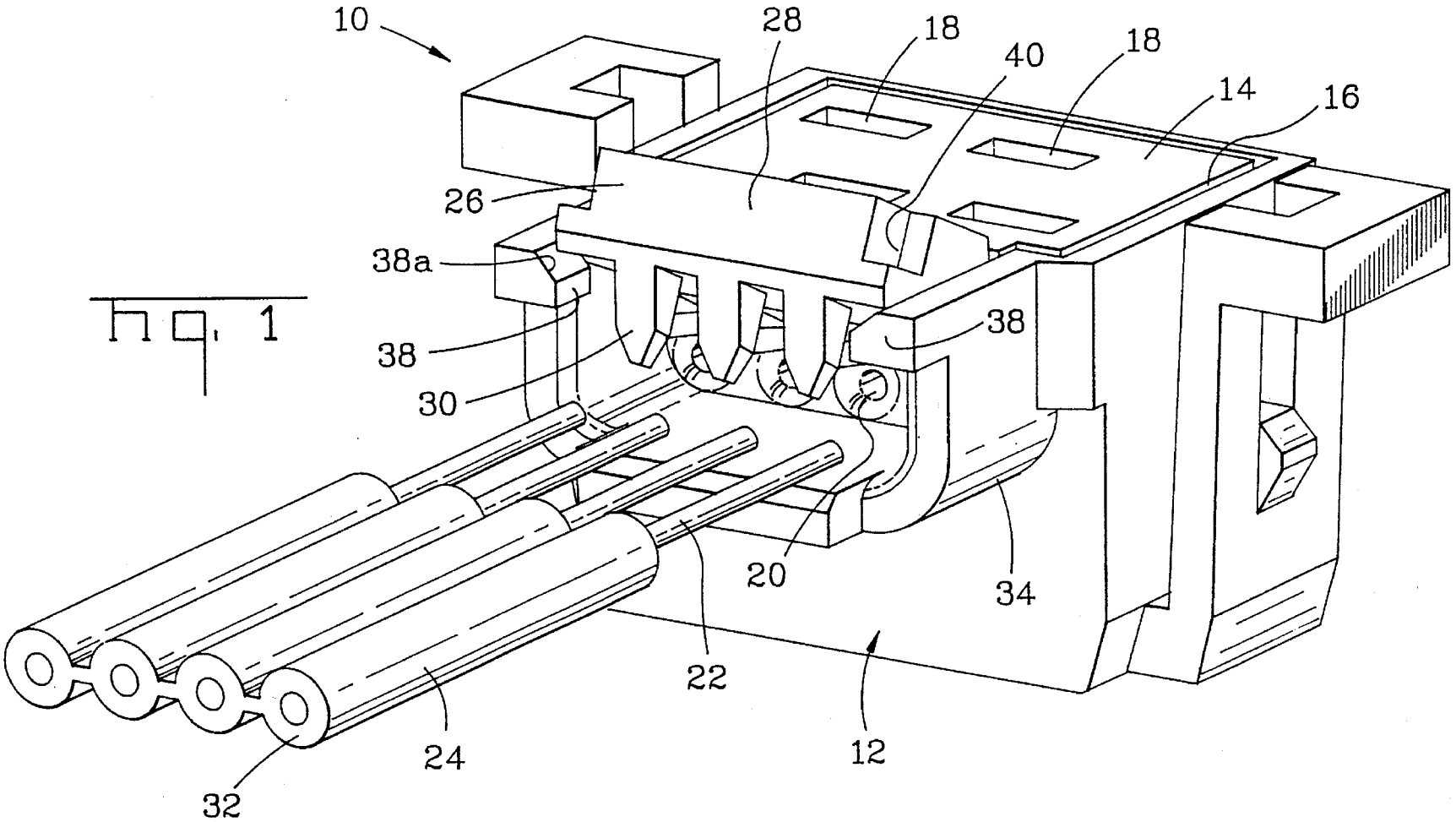
FIG. 1 is an isometric view of a cover having strain relief means located in an open position.

FIG. 1 shows an assembled view of an insulating housing, hereinafter designated insulating housing 10, for mounting in a mating female connector housing (not shown) of an electrical connector (not shown). The electrical connector is of the type shown and described in European Patent Application No. 91 311 083.9, which is assigned to the same assignee as the present invention and which is hereby incorporated by reference and made a part hereof. The insulating housing 10 comprises a housing member 12 and a cover member 14 which is detachably mounted in an opening 16 in housing member 12. The housing member 12 and cover member 14 each comprise a plurality of slots 18 for receiving a plurality of terminals (not shown) which are located in the female connector housing (not shown).

The insulating housing 12 comprises a plurality of wire receiving openings 20 each being capable of receiving a conductor 22 of an insulated wire 24. The wire receiving openings 20 are operatively aligned with the terminal receiving slots 18 such that the conductors 22 are operatively aligned in the terminal receiving slots 18 when the insulated wires 24 are inserted into wire receiving openings 20. Thereafter, the insulating housing 10 may be inserted into the female connector housing (not shown) so that the conductors 22 operatively engage the terminals (not shown) in the female connector housing (not shown) in the manner described in European Patent Application No. 91 311 083.9. In this regard, it should be noted that housing member 12 comprises a generally U-shaped shroud 34 for receiving the conductors 22 and also for facilitating guiding the conductors 22 into the wire receiving opening 20.

Figure 2:
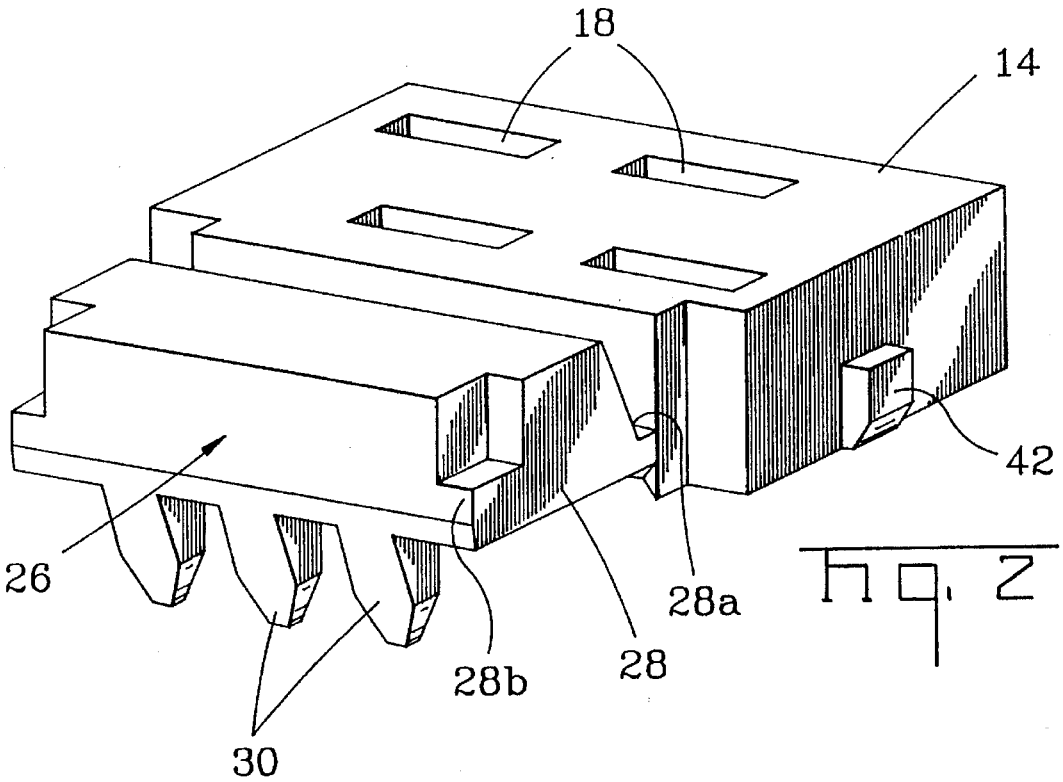
FIG. 2 is an isometric view showing details of the cover and strain relief means shown in FIG. 1.
Figure 3:
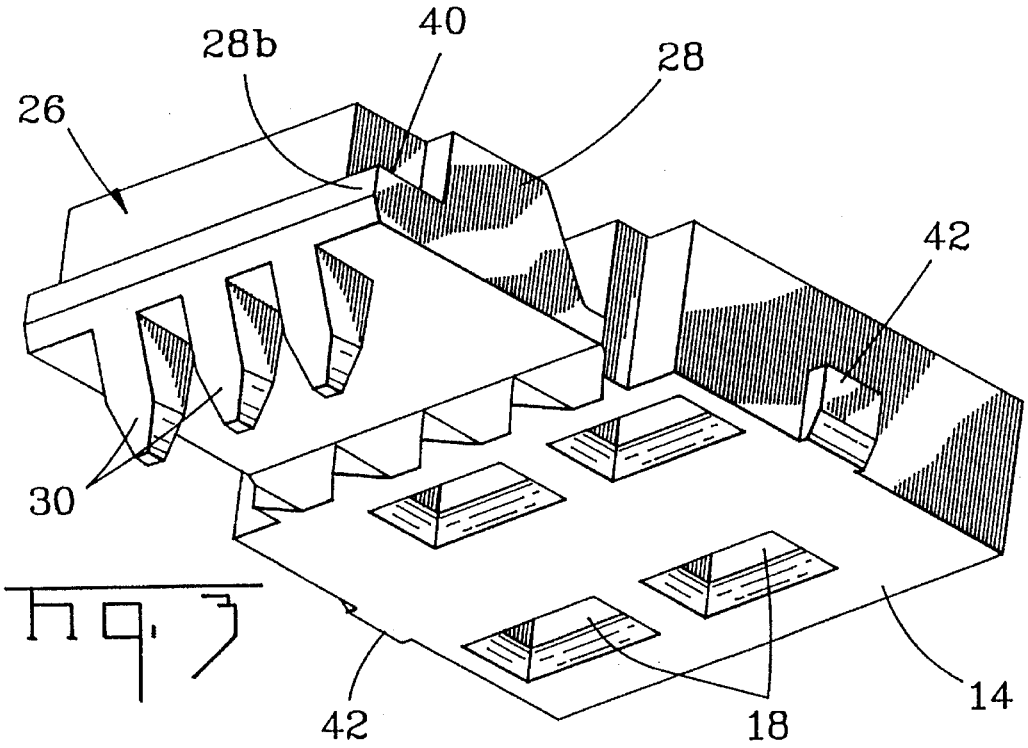
FIG. 3 is an isometric bottom view showing further details of the cover member, showing a plurality of teeth.

The insulating housing 10 also comprises strain relief means 26 (FIGS. 1–3) associated with the cover 14 for securing the plurality of insulated conductors in operative relationship with the plurality of terminal receiving slots 18. The strain relief means also functions to relieve strain on the plurality of insulated conductors 24 so that, for example, the electrical connection between the conductors 22 and the terminals (not shown) in the female connector housing (not shown) will not be interrupted if the insulated conductors 24 are pulled. As best illustrated in FIGS. 2 and 3, the strain relief means 26 is integrally formed as part of cover 14 and comprises a strain relief member 28 having a first end **28*a* and a second end 28*b*. The first end 28*a* is pivotally secured to cover 14**.

As illustrated in FIG. 3, strain relief means 26 comprises a plurality of teeth 30 located on second end **28*b* of strain relief member 28. The plurality of teeth 30 bite into insulation 32 of insulated wires 24 in order to secure the plurality of conductors 22 securely in the insulating housing 10**.

Figure 4:
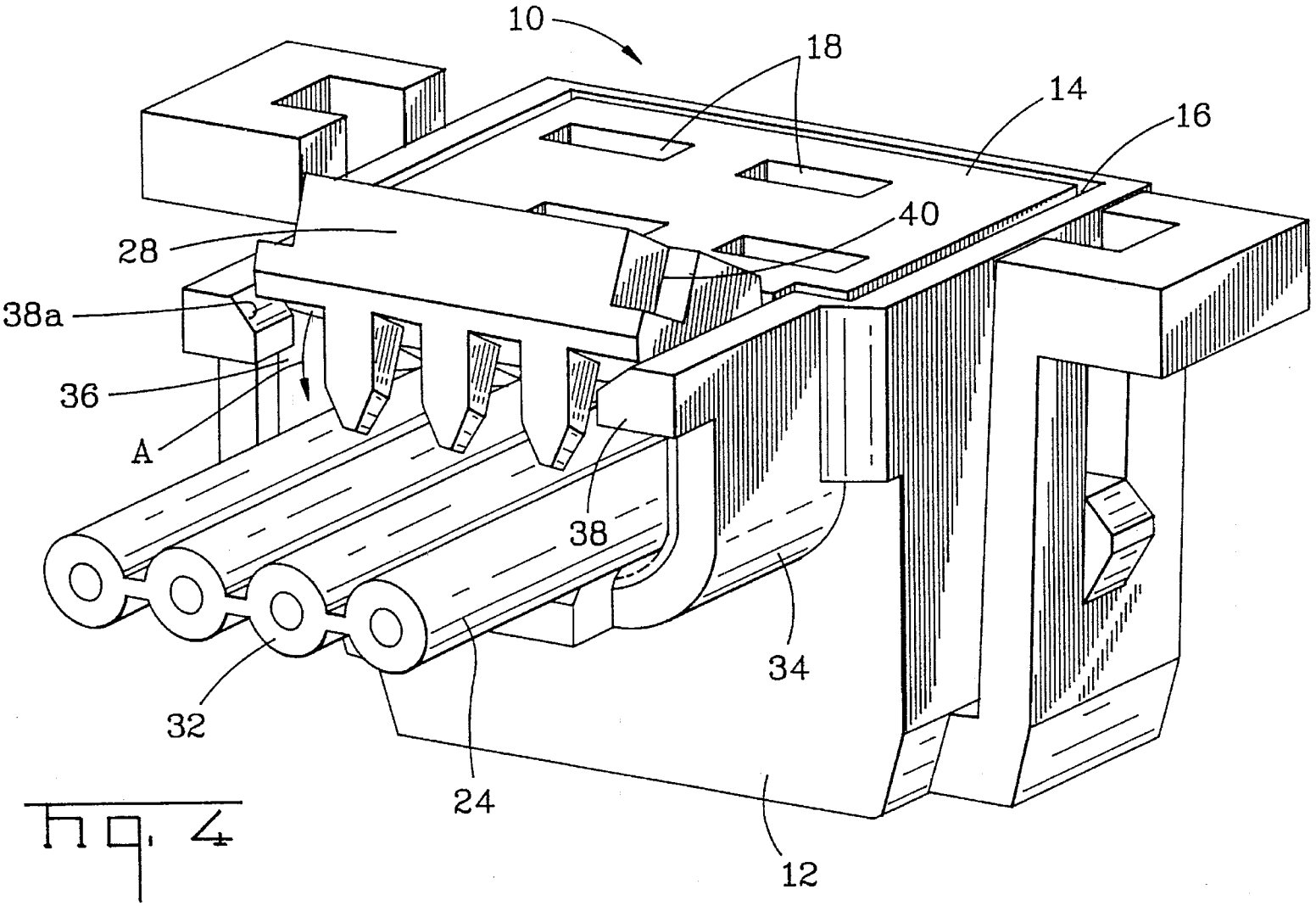
FIG. 4 is an isometric view of the insulating housing shown in FIG. 1, showing insulated wires inserted therein.
Figure 5:
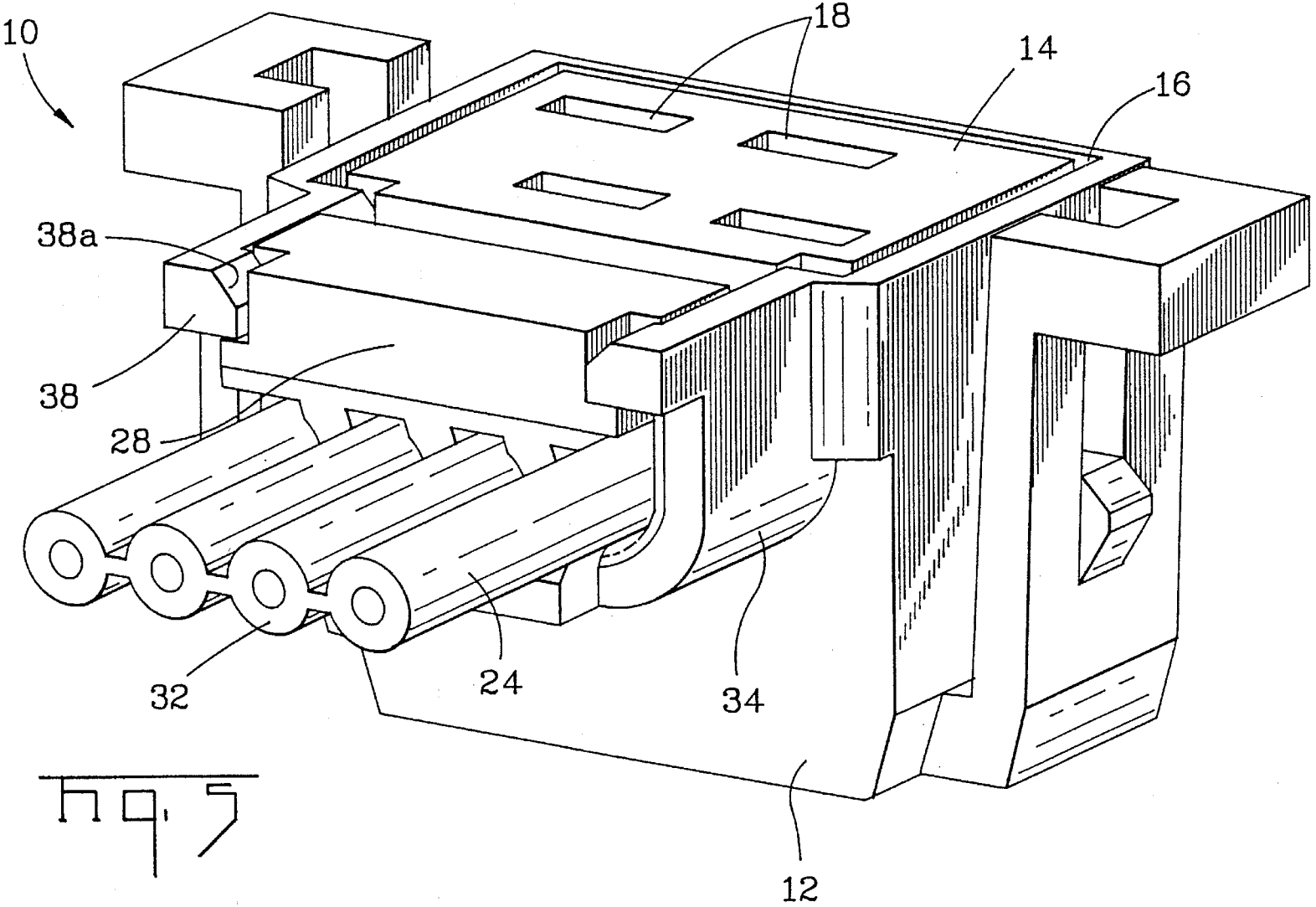
FIG. 5 is another isometric view of the insulating housing shown in FIGS. 4 and 1 showing the strain relief means pivoted to a locked position.

As best shown in FIGS. 4 and 5, the strain relief member 28 is pivotally secured to cover 14 such that it can pivot from an open position (shown in FIG. 4) to a closed position (shown in FIG. 5). As shown in FIGS. 1 and 4, shroud 34 cooperates with strain relief member 28 to define an opening 36 (FIG. 1) when strain relief member 28 is in the open position. The insulated wires 24 may be guided into opening 36 until each conductor 22 is inserted into its respective wire receiving opening 20, whereupon strain relief member 28 may be rotated in the direction of arrow A in FIG. 4 until strain relief member 28 has been fully pivoted to the locked position shown in FIG. 5.

In order to retain strain relief member 28 in a locked position, insulating housing 10 comprises locking means for locking strain relief member 28 in the locked position shown in FIG. 5. In the embodiment being described, locking means comprises a plurality of resilient detents 38 (FIGS. 1, 4 and 5) located on shroud 34. Locking means also comprises a plurality of notched out portions 40 which cooperate with the resilient detents 38 to retain strain relief member 28 in the locked position. To facilitate moving or pivoting strain relief member 28 from the open position shown in FIGS. 1 and 4 to the locked position shown in FIG. 5, the plurality of resilient detents 38 each comprise a beveled surface 38*a*.

As best shown in FIGS. 2 and 3, cover 14 comprises a pair of latches 42 which operate to latch or secure cover 14 in housing member 12 when cover 14 is inserted into aperture 16. After cover 14 has been mounted in housing member 12, the insulated wires 24 and conductors 22 may be inserted into opening 36 in the manner described previously herein. Strain relief member 28 may then be pivoted to the locked position shown in FIG. 5, thereby causing the plurality of teeth 30 to bite into insulation 32 of insulated wires 24 which, in turn, causes insulated wires 24 to be firmly secured to insulated housing 10.

Once assembled, insulating housing 10 may then be mounted or inserted into the mating female connector housing (not shown), thereby causing conductors 22 to be terminated in the terminals (not shown) of the female connector housing (not shown). The manner of operation, assembly, and mounting of the insulating housing 10 into the female connector housing (not shown) of an electrical connector (not shown) is substantially similar to that described and shown European Patent Application No. 91 311 083.9, which was mentioned earlier herein.

Advantageously then, this insulating housing 10 has improved strain relief means 26 for relieving strain on the insulated wires 24 such that when the insulating housing 10 is mounted into a mating female connector housing (not shown), the electrical connection between the insulating housing 10 and its mating female connector housing will not be interrupted.

Various changes or modifications in the invention may occur to those skilled in the art without departing from the true spirit or scope of the invention. The above description of the invention is intended to be illustrative only and not limiting and it is not intended that the invention be restricted thereto but that it be limited only by the true spirit and scope of the appended claims.

We claim:

1. An insulating housing for mounting in a female connector housing, the female connector housing having a plurality of electrical terminals, said insulating housing comprising:

a housing member;

a cover for mounting on said housing member, said housing member and said cover each having a plurality of slots for receiving the plurality of electrical terminals; and strain relief means associated with said cover for securing a plurality of insulated conductors in operative relationship with said plurality of slots and also for relieving strain on the plurality of insulated conductors.

2. The insulating housing as recited in claim 1, wherein said strain relief means is integrally formed as part of said cover.

3. The insulating housing as recited in claim 1, wherein said strain relief means comprises a strain relief member having a first end pivotally secured to said cover.

4. The insulating housing as recited in claim 1, wherein said strain relief means comprises a strain relief member which is pivotally secured to said cover, said strain relief member having a plurality of teeth for engaging insulation on the plurality of insulated conductors in order to secure the plurality of insulated conductors in the insulating housing.

5. The insulating housing as recited in claim 2, wherein said insulating housing further comprises locking means for locking said strain relief member in a locked position.

6. The insulating housing as recited in claim 1, wherein the plurality of insulating conductors to be received in the housing each comprise a conductor for engaging the plurality of electrical terminals, said housing member comprising corresponding wire receiving openings for receiving said conductors and also for guiding the conductor into operative relationship with said plurality of slots so that said conductors operatively engage said plurality of electrical terminals when said insulating housing is mounted in the female connector housing.

7. The insulating housing as recited in claim 1, wherein said housing member includes a shroud and said strain relief means comprises a strain relief member comprising a first end and a second end, said first end being pivotally coupled to said cover and said second end being pivotable from an open position to a closed position; said second end and said shroud cooperating to define an opening for receiving the insulated conductors when said second end is in said open position.

8. The insulating housing as recited in claim 7, wherein said shroud is generally U-shaped.

9. The insulating housing as recited in claim 5, wherein said locking means comprises a plurality of resilient detents located on said shroud, and a plurality of notched-out portions in said strain relief member, said plurality of notched-out portions cooperating with said plurality of resilient detents to retain said strain relief member in a locked position after said strain relief member is pivoted to said locked position.

10. The insulating housing as recited in claim 1, wherein said housing member comprises a plurality of generally L-shaped latch members which cooperate with said female connector housing to secure said insulating housing in said female connector housing when said housing member is inserted therein.

11. An insulating housing fixable to a plurality of insulated electric leads where each lead includes a conductor therein, said housing-being mountable in a female connector housing, where the female connector housing includes a plurality of electrical terminals for engaging corresponding conductors of the electrical leads, said insulating housing comprising:

a housing member having a plurality of slots, each for receiving one of the terminals when the housing member is mounted in the female connector housing, the slots being in communication with an aperture formed in the housing member, and wire receiving guide means for aligning the corresponding conductor relative to the slots; and a separate cover seated in the aperture of said housing member, where said cover includes an associated strain relief member as part of a strain relief means for securing the plurality of insulated conductors in their aligned position with the slots and relieving strain on the plurality of insulated conductors.

12. The insulating housing of claim 11, wherein said strain relief member includes a first end pivotally secured to said cover.

13. The insulating housing of claim 12, wherein said strain relief member is integrally formed as part of said over and connected therewith along said first end.

14. The insulative housing of claim 11, wherein said housing member includes a U-shaped shroud as part of the strain relief means, said shroud being for receiving the insulated conductors.

15. The insulating housing of claim 11, wherein the strain relief member includes a plurality of teeth located along a second end of the strain relief member to bite into the insulation of the conductors.

16. The insulating housing of claim 15, wherein at least one of the teeth of the strain relief member bites into the insulation of more than one of the insulated conductors.

17. The insulating housing of claim 14, wherein the strain relief member includes a plurality of notches and the shroud includes a plurality of corresponding resilient detents which are engageable to maintain the strain relief member in a locked position where it is engaged with the conductors.

18. The insulating housing of claim 11, wherein the cover includes a plurality of slots aligned with the slots of the housing for receiving the corresponding terminal therein.

19. The insulating housing of claim 11, wherein the cover is mountable within the aperture in the housing member with the strain relief member in an open position where the insulated conductors are receivable in the housing member and the cover is retained in the mounted position while the strain relief member is pivoted into a closed position where the strain relief member bites into the insulation of the conductors.

20. The insulating housing of claim 19, wherein the cover comprises a plurality of latches which operate to secure the cover to the housing member.

* * * * *